US010941582B1

(12) United States Patent
Alexander

(10) Patent No.: US 10,941,582 B1
(45) Date of Patent: Mar. 9, 2021

(54) POOL COVER PUMP SLED

(71) Applicant: Bart R. Alexander, Highland, IL (US)

(72) Inventor: Bart R. Alexander, Highland, IL (US)

( * ) Notice: Subject to any disclaimer, the term of this patent is extended or adjusted under 35 U.S.C. 154(b) by 96 days.

(21) Appl. No.: 16/435,478

(22) Filed: Jun. 8, 2019

Related U.S. Application Data

(60) Provisional application No. 62/682,583, filed on Jun. 8, 2018.

(51) Int. Cl.
*E04H 4/16* (2006.01)
*F04D 29/60* (2006.01)

(52) U.S. Cl.
CPC ..... *E04H 4/1636* (2013.01); *F04D 29/605* (2013.01)

(58) Field of Classification Search
CPC ..... E04H 4/16; E04H 4/1609; E04H 4/1636; E04H 4/1618; E04H 4/1627; F04D 29/605; A47L 5/02; A47L 7/0019; Y10S 210/923; E02B 15/106; E02B 15/10
USPC ..... 15/1.7, 246.4
See application file for complete search history.

(56) References Cited

U.S. PATENT DOCUMENTS

| | | | | |
|---|---|---|---|---|
| 3,008,160 | A | 11/1961 | West | |
| 3,547,553 | A | 12/1970 | Stanfield | |
| 3,579,657 | A | 5/1971 | Gurrieri | |
| 4,024,063 | A | 5/1977 | Mori | |
| 4,834,138 | A | 5/1989 | Dellasso | |
| 5,186,610 | A | 2/1993 | Pennington et al. | |
| 5,624,238 | A | 4/1997 | Herbert | |
| 6,058,540 | A | 5/2000 | Ryall | |
| 9,290,958 | B2 * | 3/2016 | Lopez | E04H 4/1654 |
| 9,499,996 | B2 | 11/2016 | Johnson et al. | |
| 9,512,965 | B2 | 12/2016 | Acklin | |
| 9,957,693 | B2 | 5/2018 | Fischmann Torres et al. | |
| 2006/0081520 | A1 | 4/2006 | Lord et al. | |
| 2008/0190838 | A1 | 8/2008 | Reardon | |
| 2012/0049554 | A1 | 3/2012 | Santoloci | |
| 2014/0157508 | A1 | 6/2014 | Drechsel | |

* cited by examiner

*Primary Examiner* — Kenneth J Hansen
(74) *Attorney, Agent, or Firm* — Grace J. Fishel

(57) ABSTRACT

A sled for a pool cover pump for keeping the pump from tipping over in use, reducing pump clogging and guarding against damaging a plastic pool cover. The sled has a base unit with a platform mounted on runners which spread the load on the pool cover and which elevate the pool cover pump above the pool cover a distance that the platform serves as a gate or doctor blade preventing leaves and other debris from getting into the pump inlet.

8 Claims, 5 Drawing Sheets

POOL COVER PUMP SLED

BACKGROUND OF THE INVENTION

Field of the Invention

The present invention relates to a pool cover pump sled that keeps the pump from tipping over in use, reduces pump plugging with debris and guards against damaging a plastic pool cover.

Brief Description of the Prior Art

A typical pool cover is a flexible sheet of plastic material and is used with a swimming pool, spa, hot tub or wading pool to prevent rain water, debris and the like from getting into the water. The cover may also effectively maintain the water's temperature and prevent evaporation as well. With an inground or aboveground swimming pool, the pool cover is typically held along the perimeter of the pool by sand bags or other weights. Necessarily the pool cover inclines downwardly from the coping of the pool to the central pool area, where the cover rests on the water in the pool beneath.

Water may accumulate on top of the pool cover from a hole in the cover, from misdirected sprinklers or from rain or snow. The puddled water also commonly contains debris, such as fallen leaves, sticks, dead insects and dirt. Water tends to migrate towards depressions in the cover and form pools. A pool cover serves as a safety net should a child or pet fall into the pool but the pools of water on the pool cover may also be a drowning risk. Another problem with plastic pool covers is that they can only withstand a limited amount of pressure and may tear under the weight of an unwanted pool of water and debris.

In order to remove accumulated water from a pool cover, swimming pool owners may place and electric pump having a mesh strainer. As water is strained and pumped away through a hose, debris tends to accumulate in the filter and may eventually foul the pump. The swimming pool owner must then remove the pump from the cover and manually clean the mesh filter in order to restore effective water pumping.

Another shortcoming with pool cover pumps is that they are frequently mounted on a flat base that comes in contact with the pool cover. The contact between the pump's flat base, and particularly the edges of the flat base, leads to tipping of the pump and the edges of the flat base may also slit the pool cover. Moreover the pool cover pump when pushed into a standing pool of water adds a localized load to an already stressed area and may cause the cover to tear because of that factor too.

BRIEF SUMMARY OF THE INVENTION

In view of the above, it is an object of the present invention to provide a way to prevent a pool cover pump from tipping over in use. It is another object to provide a way to prevent a pool cover pump from damaging a pool cover and to provide for longer times between when the pool cover pump filter needs to be cleaned. Other objects and features of the invention will be in part apparent and in part pointed out hereinafter.

In accordance with the invention, a pool cover pump sled is provided for use with a manual or automatic pool cover pump. The sled comprises a base unit mounted on runners. As shown in the drawings the base unit is made of steel but may be made of other suitable materials such as fiberglass, plastic or the like. In similar manner the runners are shown as made of pliable plastic but may be formed of steel, fiberglass or the like.

The base unit has a rectangular platform with sidewalls, first and second end walls and an open top. The platform has perforations in the floor for registry with a pump inlet of a pool cover pump. The first end wall has an aperture through which a male discharge connector of the pool cover pump may be connected with a female hose connector of a garden hose with the first end wall sandwiched between thereby firmly seating the pool cover pump of the platform. The first end wall also has first and second spaced apart flanges each of which has an aperture for receiving a pin configured for attachment of a pool extension pole by means of which the sled may be pushed and pulled across the pool cover.

The runners support the platform above the pool cover are longer than the platform and extend outside the sidewalls thereby spreading the load on the pool cover. The platform serves as a gate or doctor blade excluding leaves and other debris from fouling the inlet of the pool cover pump setting on the platform.

The invention summarized above comprises the constructions hereinafter described, the scope of the invention being indicated by the subjoined claims.

BRIEF DESCRIPTION OF THE SEVERAL VIEWS OF THE DRAWINGS

In the accompanying drawings, in which one of various possible embodiments of the invention is illustrated, corresponding reference characters refer to corresponding parts throughout the several views of the drawings in which.

DETAILED DESCRIPTION OF AT LEAST ONE PREFERRED EMBODIMENT OF THE INVENTION

Figure 1:
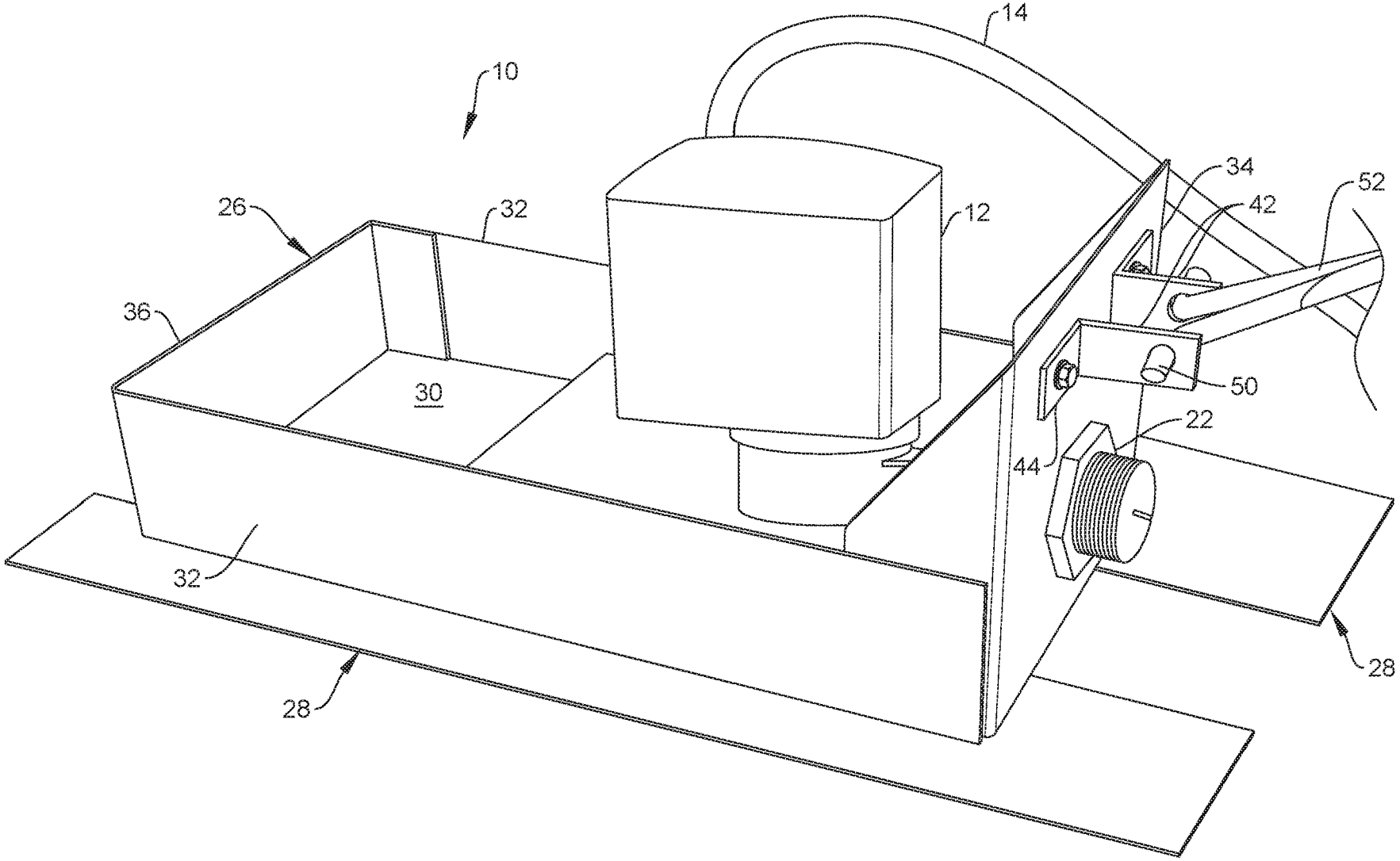
FIG. 1 is perspective view of a pool cover pump sled in accordance with the present invention viewed from a front end of the sled and shown with a pool cover pump secured thereto.

Referring to the drawings more particularly by reference character, reference numeral 10 refers to a pool cover pump sled in accordance with the present invention. As shown in FIG. 1, a pool cover pump 12 is shown mounted on sled 10. Pool cover pump 12 may be either manually operated or automatic. Manual systems are less expensive but the swimming pool owner must physically turn the system on and off. Automatic systems, on the other hand, detect when the cover needs to be pumped, for example after a rain. Pool cover pump 12 operates via electricity and thus includes a power cord 14 that is connected to a source of electricity (not shown).

Figure 2:
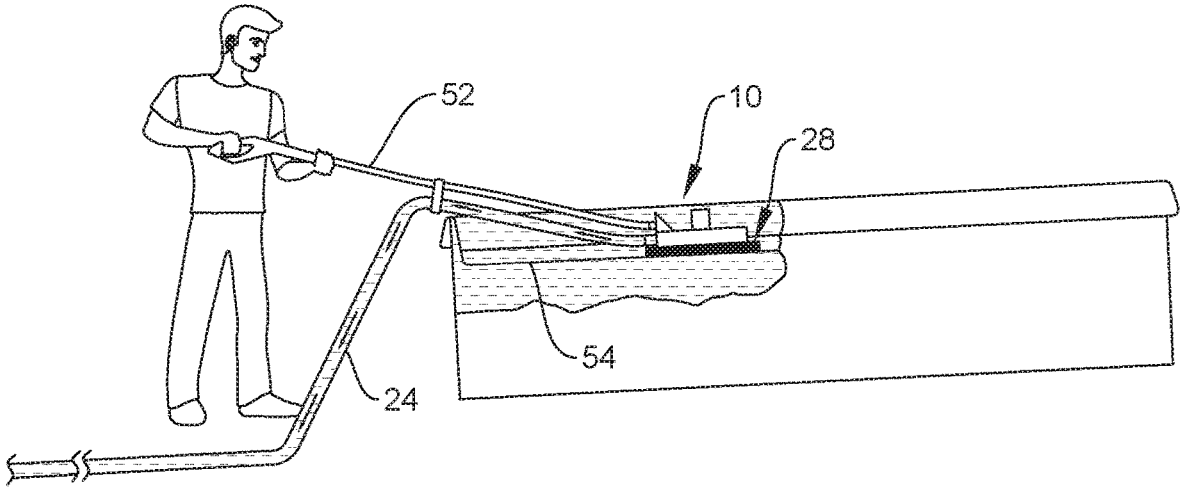
FIG. 2 is a side elevation illustrating an aboveground swimming pool broken away to show a pool cover, a sled with a pool cover pump mounted thereon in accordance with the present invention, a pool extension pole and a garden hose illustrating use of the pool cover pump in pumping off accumulated water on the pool cover.
Figure 3:
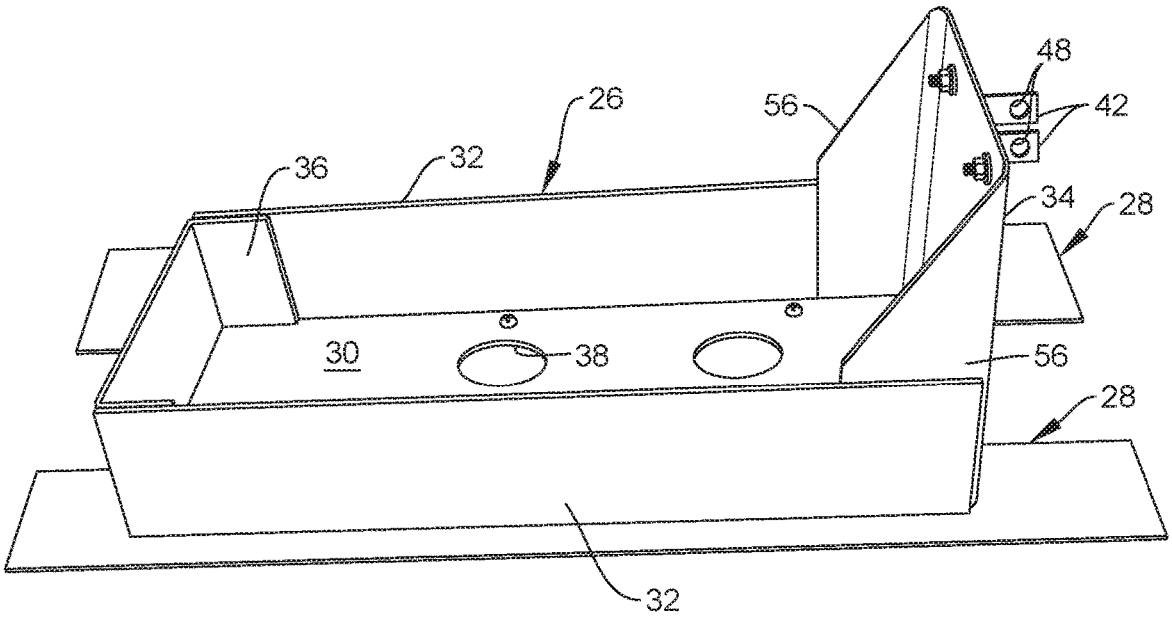
FIG. 3 is a side perspective view of the sled.
Figure 6:
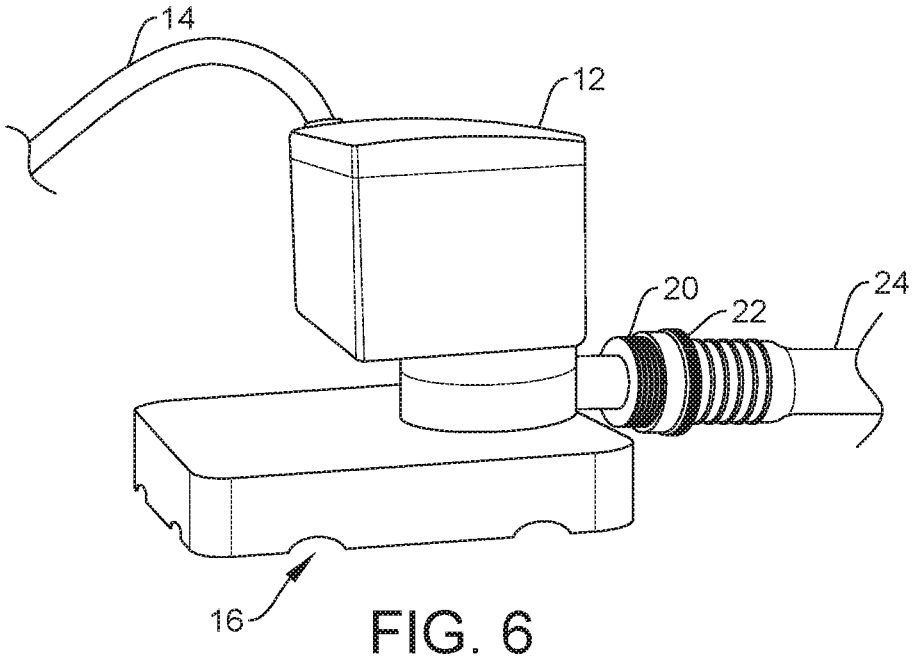
FIG. 6 is a perspective view of a conventional pool cover pump with a flat base; and, FIG. 7 is an exploded perspective view of the pool cover pump looking into the pump inlet and showing a mesh filter screen which fits therein.
Figure 7:
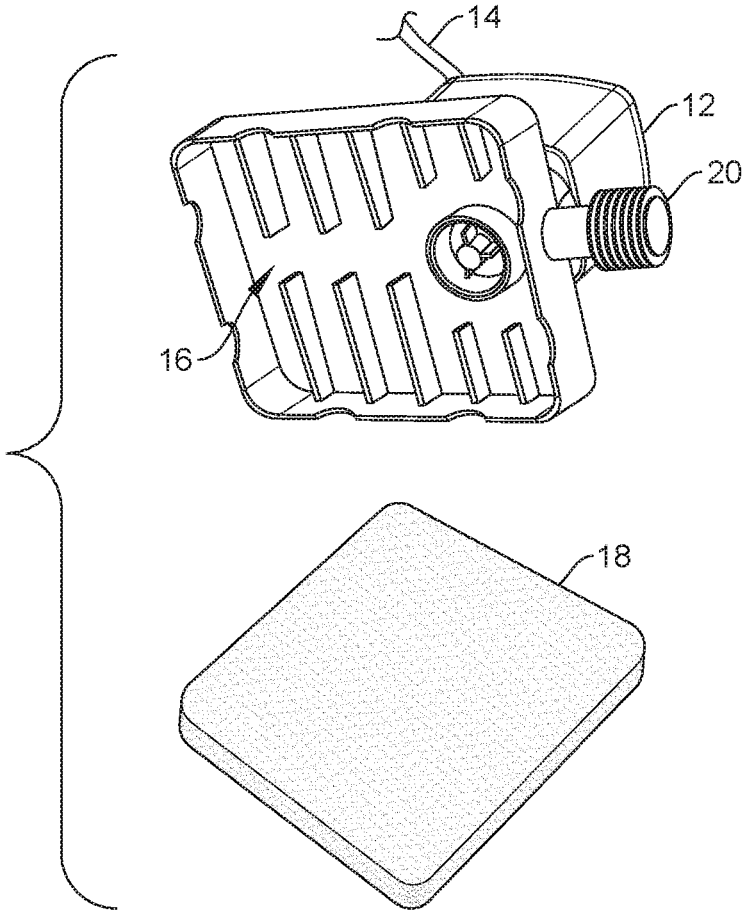

As best seen in FIGS. 6 and 7, an inlet 16 to pool cover pump 12 typically has a flat base with a metallic or plastic mesh-type screen 18 for filtering the water prior to its entry into the pump. Pool cover pump 12 has a male discharge connector 20 which is threaded such that a first end of a typical garden hose 24 with a female hose connector 22 can be connected to male discharge connector 20. With reference to FIG. 2, a second end of garden hose 24 is placed in the grass or surrounding deck area. As water flows through the screen 18 in inlet 16 to pool cover pump 12, debris is filtered and water is pumped into and through the pump and away from the pool cover through the attached garden hose 24.

Figure 4:
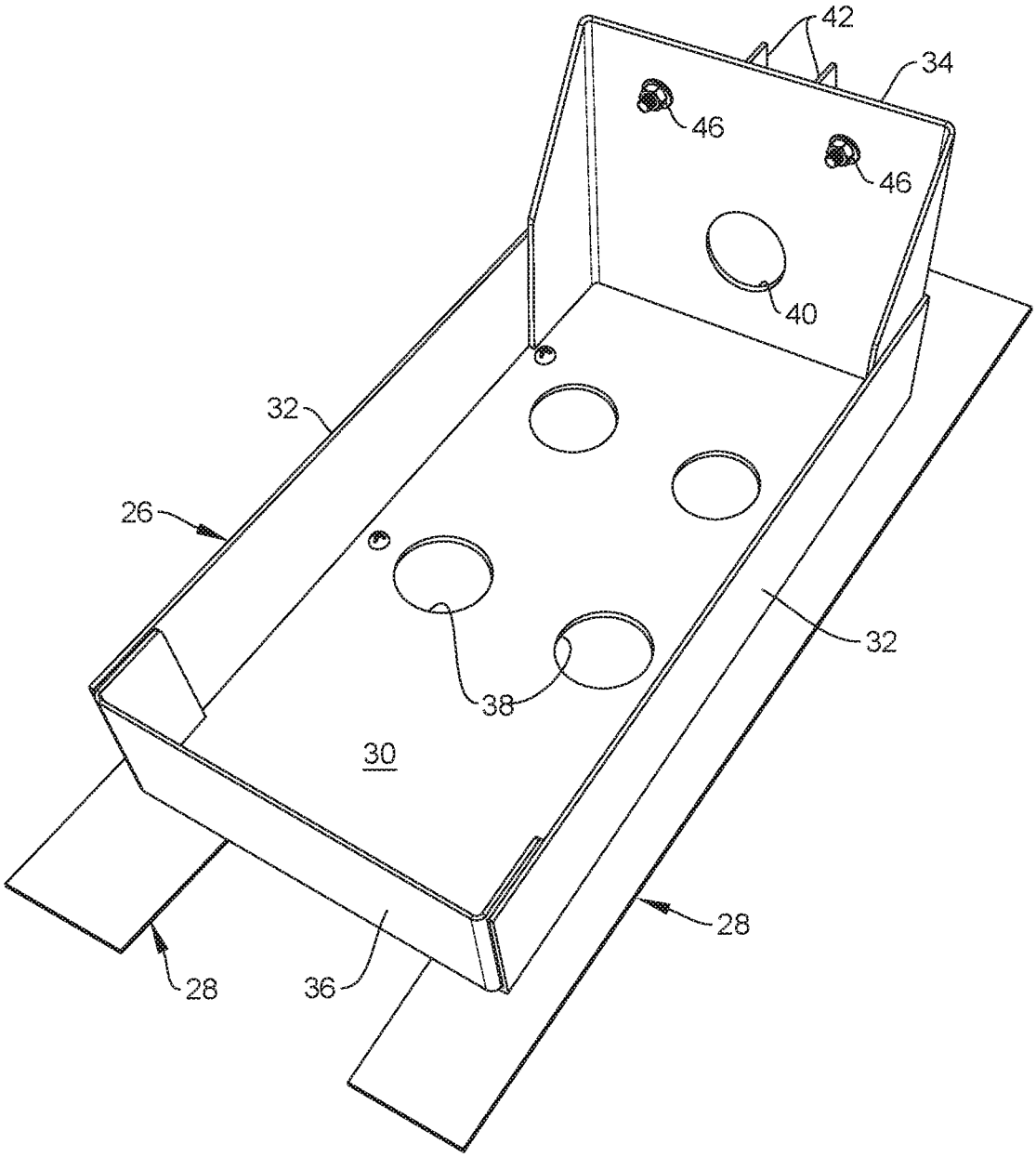
FIG. 4 is a perspective view of the sled viewed from a rear end of the sled.
Figure 5:
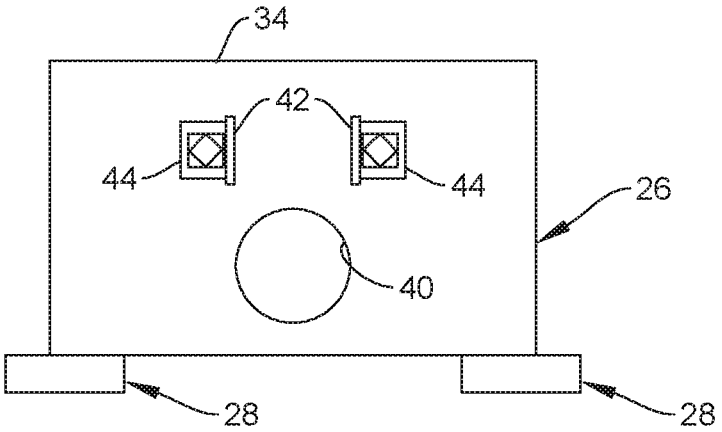
FIG. 5 is front elevation of the sled.

Sled 10 comprises a base unit 26 mounted on spaced apart runners 28. Base unit 26 has a rectangular platform 30 with sidewalls 32 and first and second end walls 34, 36 and an open top. Sidewalls 32 may be integrally formed with platform 30 and bent at right angles thereto. Platform 30 has a perforated floor upon which pool cover pump 12 may be placed with pump inlet 16 in flowable registry with at least one of perforations 38 in platform 30. When base unit 26 is formed of steel, as seen in FIG. 4 a two by two grid of four equally spaced perforations 38 may be provided in platform 30 configured for flowable registry with screen 18 in pump inlet 16.

First end wall 34 has an aperture 40 for passage of male discharge connector 20 of pool cover pump 12. As female hose connector 22 is threaded on male discharge connector 20, pool cover pump 12 is cinched against first end wall 34 such that it cannot tip over on platform 30.

First and second end walls 34, 36 are U-shaped members attached inside of sidewalls 32 at first and second ends of platform 30. Positioned vertically above aperture 40 in first end wall 34 are first and second spaced apart L-shaped flanges 42 with a foot 44 of each member bolted 46 or otherwise attached to first end wall 34. As shown, each member of the paired flanges 42 has an aperture 48 for receiving a pin 50 configured for attachment of a pool extension pole 52 for use in moving sled 10 across a pool cover 54 as shown in FIG. 2. First end wall 34 may be reinforced with gussets 56, illustrated as triangular and integrally formed at right angles with first end wall 34. Gussets 56 are attached inside of sidewalls 32 and are seated on platform 30.

Runners 28 may be formed of steel, fiberglass or plastic but are preferably formed of a pliable plastic such as ⅜ inch thick low-density polyethylene (LDPE) plastic. Runners 28 are longer than platform 30, are attached to platform 30 under sidewalls 32 and extend outside sidewalls 32. Runners 28 thus increase the length and width of base unit thereby spreading the load of pool cover pump 12 on pool cover 54. Runners 28 also space platform 30 a distance above pool cover 54 such that platform 30 serves a gate or doctor blade excluding debris from under the platform as sled 10 is moved across pool cover 54 by extension pole 52.

In use, a pool cover pump 12 is mounted on base unit 26 with its pump inlet 16 over perforations 38 in platform 30 and with its male discharge connector 20 passing through and being held in aperture 40 in first end wall 34 with female hose connector 22 of garden hose 24 with first end wall 34 sandwiched between. Pool extension pole 52 may be pinned to flanges 42 permitting pivotal movement of the extension pole so that the user may move sled 10 outward towards the center of the pool. Pool cover pump 12 with its male discharge connector 20 in aperture 40 in first wall 34 is securely seated in sled 10 such that it cannot tip over on platform 30. Runners 28 spread the load applied by the weight of the pool cover pump 12 over an area larger than the flat pump base to avoid tearing the pool cover and the flat pump base is elevated above the pool cover by platform 30 such that its flat side edges do not damage the pool cover. The floor of platform 30 serves as a gate or doctor blade excluding debris from under the platform such that floating leaves, sticks and the like are not inducted through perforations 38 into the pump inlet 16 and accumulate in mesh screen 18 thus reducing the efficiency of pool cover pump 12.

From the above, it is seen that sled 10 prevents pool cover pump 12 from tipping over in use and from tearing or cutting pool cover 54 while providing for longer straining of accumulated water before cleaning of pool cover pump filter screen 18 . As various changes could be made in the above constructions without departing from the scope of the invention, it is intended that all matter contained in the above description or shown in the accompanying drawings shall be interpreted as illustrative and not in a limiting sense.

What is claimed:

1. A pool cover pump sled comprising a base unit with a rectangular platform having sidewalls and first and second end walls and an open top, said platform mounted on a pair of spaced apart runners, said platform having a perforated floor comprising perforations for connection to a pool cover pump with a pump inlet in flowable registry with at least one of the perforations in the perforated floor, said first end wall having first and second spaced apart flanges each of which having an aperture for receiving a pin configured for attachment to a pool extension pole, said first end wall having an aperture configured for passage of a discharge connector of the pool cover pump, said runners configured for increasing the width and the length of the base unit and elevating the floor such that the platform serves to exclude debris from under the platform.

2. The pool cover pump sled of claim 1 wherein the runners are made of steel, plastic or fiberglass.

3. The pool cover pump of claim 2 wherein the runners are formed of ⅜ inches thick low-density polyethylene (LDPE) plastic.

4. The pool cover pump sled of claim 1 where the perforations in the platform form a two by two grid of four equally spaced holes.

5. A pool cover pump sled comprising a base unit formed of steel with a rectangular platform having sidewalls and first and second end walls and an open top, said platform mounted on a pair of spaced apart runners, said platform having a perforated floor comprising perforations for connection to a pool cover pump with a pump inlet in flowable registry with at least one of the perforations in the platform, said first end wall having a pair of spaced apart flanges each of which having an aperture for receiving a pin configured for attachment to a pool extension pole, said first end wall having an aperture configured for passage of a discharge connector of the pool cover pump, said first end wall reinforced with triangular gussets attached to the sidewalls and the platform, said runners formed of a pliable plastic and are configured for increasing the width and the length of the base unit and elevating the platform such that the platform serves to exclude debris from under the platform.

6. The pool cover pump sled of claim 5 wherein the runners are formed of ⅜ inch thick low-density polyethylene (LDPE) plastic.

7. The pool cover pump sled of claim 5 wherein the perforations in the platform form a two by two grid of four equally spaced holes configured for flowable registry with a plastic or metal mesh screen in an inlet of a pool cover pump.

8. The pool cover pump sled of claim 5 wherein the pair of spaced apart flanges are positioned vertically above the aperture in the first end wall for passage of the discharge outlet of the pool cover pump.

* * * * *